US006397751B1

(12) United States Patent
Ramsay

(10) Patent No.: US 6,397,751 B1
(45) Date of Patent: Jun. 4, 2002

(54) METHOD OF EXTRACTING A PRINTING PLATE FROM A PLATE CYLINDER OF A PRINTING UNIT

(75) Inventor: Bertrum Scott Ramsay, Wolfeboro, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/714,577

(22) Filed: Nov. 16, 2000

(51) Int. Cl.[7] ..... B41F 1/28; B41F 21/00
(52) U.S. Cl. ..... 101/477; 101/415.1
(58) Field of Search ..... 101/415.1, 477, 101/485, 409, 378, 479

(56) References Cited

U.S. PATENT DOCUMENTS

| | | | | |
|---|---|---|---|---|
| 5,284,093 A | | 2/1994 | Guaraldi et al. | 101/415.1 |
| 5,390,603 A | | 2/1995 | Hauck et al. | 101/477 |
| 5,443,006 A | | 8/1995 | Beisel et al. | 101/477 |
| 5,495,805 A | | 3/1996 | Beisel et al. | 101/477 |
| 5,537,926 A | | 7/1996 | Beisel et al. | 101/477 |
| 5,699,740 A | * | 12/1997 | Gelbart | 101/389.1 |

FOREIGN PATENT DOCUMENTS

| | | |
|---|---|---|
| DE | 39 40 796 A1 | 6/1991 |

* cited by examiner

*Primary Examiner*—Leslie J. Evanisko
(74) *Attorney, Agent, or Firm*—Laurence A. Greenberg; Werner H. Stemer; Gregory L. Mayback

(57) ABSTRACT

Printing plates can be reliably extracted from a plate cylinder with an automatic plate changer even when the plate lock has a very narrow plate gap between the trailing edge and the leading edge of the printing plate. First, the trailing edge of a printing plate is released by the locking member and the printing plate is elastically deformed at the trailing edge. This allows the guide fork of the automatic plate changer to reliably peel the printing plate away from the plate cylinder. In addition, the guide fork may engage the leading edge of the printing plate after the plate lock has been disengaged once more and peel the leading edge away from the plate cylinder by pivoting away from the cylinder.

10 Claims, 1 Drawing Sheet

METHOD OF EXTRACTING A PRINTING PLATE FROM A PLATE CYLINDER OF A PRINTING UNIT

BACKGROUND OF THE INVENTION

Field of the Invention

The invention lies in the field of printing technology. More specifically, the invention pertains to a method of extracting a printing plate from a plate cylinder in a printing unit.

Printing plates are typically thin metal foils formed with a surface that defines an image to be printed. The printing plate is clamped onto a plate cylinder that is rotatably mounted in a printing unit. After the plate has been inked, the printing ink is transferred from the image surface of the printing plate onto the material to be printed in the rotary printing machine. In offset printing, for instance, the print image is transferred from the printing plate onto a rubber blanket and from the rubber blanket onto paper or another material.

The useful surface of the printing plate extends from its trailing edge to its leading edge. In modern plate cylinders, the gap between the leading and trailing edges of the plate are made increasingly narrower, so as to limit the extent of the non-print area on the plate cylinder.

We described in U.S. Pat. No. 5,284,093 a plate cylinder with an open passage in which a plate locking mechanism is disposed. The leading and trailing edges, i.e., the edge portions, of the printing plate are held in a common gap that is formed between the locking mechanism and one wall of the passage in the plate cylinder. After the locking mechanism is closed, the gap between the edge portions of the printing plate is very narrow.

One problem associated with the narrowing of the plate gap is that it becomes more difficult for automatic plate changers to remove a spent printing plate. Such an automatic plate changer is described, for instance, in U.S. Pat. No. 5,390,603 and a magazine and plate change system is described in U.S. Pat. Nos. 5,443,006; 5,495,805; and 5,537,926. In those systems, old printing plates are automatically removed from the plate cylinder and stored in a magazine. A new plate is automatically dispensed from the magazine and clamped into the plate cylinder for starting a new print job.

While those prior systems operate quite reliably in general, they were originally designed with much larger plate gaps in mind. With the decreased gap, however, difficulties have arisen with regard to the plate change automation, because the target gap for the plate change mechanism is decreased so far that a reliable "hit" cannot always be ensured and the edge of the plate may become caught during the removal with the prior art systems.

SUMMARY OF THE INVENTION

It is accordingly an object of the invention to provide a method of extracting a printing plate from the plate cylinder of a printing unit, which overcomes the above-mentioned disadvantages of the heretofore-known devices and methods of this general type and which is enabled to reliably change a plate with a very small target defined by the narrow plate gap.

With the foregoing and other objects in view there is provided, in accordance with the invention, a method of extracting a printing plate from a plate cylinder rotatably mounted in a printing unit, wherein a trailing edge and a leading edge of the printing plate are retained by a locking member in a plate gap of the plate cylinder. The method comprises the following steps:

releasing the trailing edge of the printing plate from the locking member of the plate cylinder;

plastically deforming the printing plate at the trailing edge; and peeling the printing plate away and removing the printing plate from the plate cylinder.

In accordance with an added feature of the invention, the releasing step comprises axially displacing a lockup bar within an open passage of the plate cylinder and projecting a bearing surface of the lockup bar radially beyond a peripheral surface of the plate cylinder.

In accordance with an additional feature of the invention, the deforming step comprises forcing the printing plate towards the peripheral surface of the plate cylinder in a vicinity of the lockup bar projecting beyond the peripheral surface.

In accordance with another feature of the invention, the printing plate is biased against the peripheral surface of the plate cylinder with a tucker bar of an automatic plate change mechanism of the printing unit.

In accordance with a further feature of the invention, the peeling step comprises placing a guide fork of an automatic plate change mechanism in the vicinity of the plastically deformed trailing edge, rotating the plate cylinder to force the trailing edge to run onto the guide fork, and deflecting the printing plate away from the plate cylinder while continuing the rotation of the plate cylinder.

The invention is most applicable in the context of narrow plate gaps, i.e., where the leading and trailing edges of the printing plate are locked with a plate gap of less than 5 mm, and preferably less than 1 mm. In the preferred embodiments, the invention ensures that the printing plate is reliably "hit" by the automatic plate changer. This ensures, for example, that automatic plate changes can occur reliably with the narrow gap cylinders used with the seamless rubber blanket.

In accordance with again an added feature of the invention, the guide fork is pivoted to cause its tip to engage the leading edge of the printing plate (the edge that is removed last from the cylinder) and move the leading edge away from the locking member. The translational movement of the guide fork thus essentially forces the leading edge away from the plate gap.

With the above and other objects in view there is provided a further method of extracting a printing plate, which comprises:

after the trailing edge of the printing plate has been released from the locking member, removing the printing plate from the plate cylinder with a guide fork of an automatic plate change mechanism, by rotating the plate cylinder and causing the printing plate to unravel from the plate cylinder; and prior to the completed removal of the printing plate, unbending the bent-over leading edge of the printing plate to substantially flatten the leading edge. Flattening the leading edge ensures that the edge portion will come free from the plate cylinder and that the old printing plate can be properly handled in the automatic plate changer.

Other features which are considered as characteristic for the invention are set forth in the appended claims.

Although the invention is illustrated and described herein as embodied in a method of automatically extracting a printing plate from the plate cylinder of a printing unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
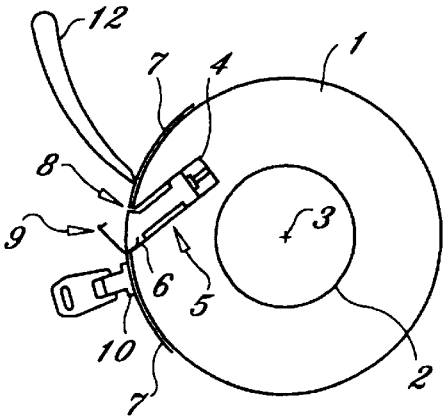
FIG. 1 is a diagrammatic side view of a plate cylinder and a printing plate during its removal.

DESCRIPTION OF THE PREFERRED EMBODIMENTS:

Referring now to the figures of the drawing in detail and first, particularly, to FIG. 1 thereof, there is seen a plate cylinder 1 with a stub shaft 2 that is rotatably mounted about a rotary axis 3 in the machine frame of a printing unit. The plate cylinder 1 is formed with an open passage 4 in which there is disposed a locking member 5 with a lockup bar 6.

Such a plate cylinder 1 with a corresponding locking member 5 is described in U.S. Pat. No. 5,284,093, the disclosure of which is herewith expressly incorporated by reference. A printing plate 7 is disposed on the plate cylinder 1. The plate 7 extends from one edge portion, referred to as a leading edge 8, around the jacket surface of the plate cylinder 1, to the opposite edge portion, referred to as a trailing edge 9. These definitions follow from the rotation of the plate cylinder during printing, which is in counter-clockwise direction in the drawing figures. During printing, the bent segments of the leading edge 8 and the trailing edge 9 are clamped in a plate gap defined between a wall of the open passage 4 and the lockup bar 6. When it is locked, the lockup bar 6 essentially completes (except for a small gapped seam) the peripheral surface of the plate cylinder 1 with its bearing surface, which is appropriately curved at the cylinder radius. The leading and leading edges 9, 8 are locked into the plate cylinder 1 so as to minimize the plate gap. The plate gap may be less than approximately 5 mm and even less than 1 mm. Preferably, the leading and leading edges 9, 8 contact each other so as to minimize the plate gap as much as possible.

The clamping action of the lockup bar 6 can be released by axially moving the lockup bar 6 out of the passage 4. The term "axially," in this context, refers to the axis of the open passage 4 which extends along a secant chord of the cylinder 1. As the lockup bar 6 is shifted outwardly of the passage 4, the clamping gap widens and the trailing and trailing edges 8,9 are released.

Figure 2:
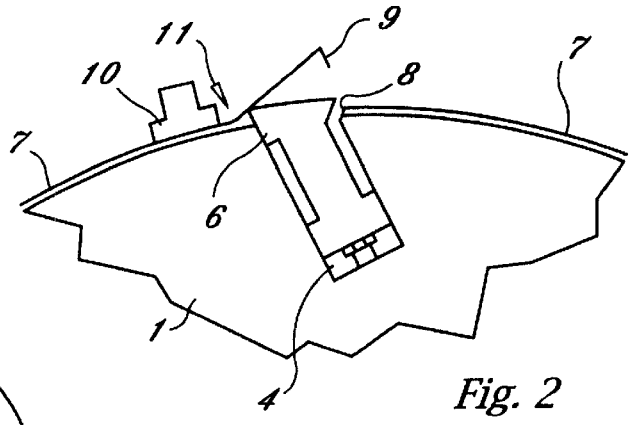
FIG. 2 is an enlarged detail thereof.

Referring now to the more detailed view of FIG. 2 in combination with FIG. 1, there is also illustrated a tucker bar 10 which is generally used to "tuck" the trailing and trailing edges 8,9 of the plate into the clamping gap by radially pushing the plate edges towards the plate cylinder 1. According to the invention, the tucker bar 10 can be used to plastically deform the printing plate 7 so as to assure that the automatic plate changer can reliably remove the plate 7. For that purpose, the plate cylinder 1 is rotated so as to place the tucker bar 10 just counter-clockwise of the lockup bar 6. At this point, both the tucker bar 10 and the lockup bar 6 are actuated with the plate 7 between them. The tucker bar 10 may also be actuated after the lockup bar 6, or vice versa. Since the lockup bar 6 projects above the cylinder jacket surface, the plate 7 is plastically deformed along a bend line 11 so that it projects outwardly away from the plate cylinder 1. The trailing edge 9 will no longer spring back into the clamping gap, even when the lockup bar 6 is once more retracted into the channel 4. At this point, the plate 7 is ready for removal by the automatic plate changer and a guide fork 12 of the plate changer can reliably "hit" and deflect the plate into the disposal magazine when the cylinder 1 is rotated clockwise. Upon rotation of the plate cylinder 1, the trailing edge 9 of the plate 7 is deflected (to the left in FIG. 1) by the guide fork 12 away from the plate cylinder 1.

The method according to the invention can be implemented without adding any devices in the printing unit. The plate 7 can be permanently deformed with already existing devices.

Figure 3:
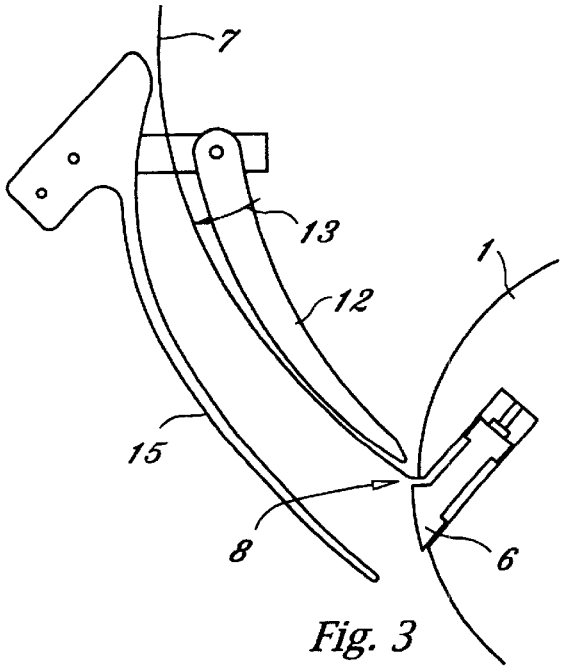
FIG. 3. is a diagrammatic partial side view of a plate cylinder and a guide chute of an automatic plate changer, showing the system just prior to the removal of the trailing edge of the printing plate.

Referring now to FIG. 3, there is illustrated an additional feature of the invention which may be referred to as positive plate edge removal. Here, the guide fork 12 of the plate changer is pivotally, i.e. rotatably disposed. After the plate gap is opened by extending the lockup bar 6, the plate cylinder 1 is rotated clockwise so that the plate is peeled into the chute between the guide fork 12 and a guide 15, until the forward end of the guide fork 12 reaches the leading edge 8 of the plate 7.

At this point, the guide fork 12 is slightly rotated clockwise (about 50 to 200) and, due to the translatory movement of the free end of the guide fork 12, the lead edge 8 of the plate 7 is "jerked" from the gap. In most cases, the plate removal mechanism with its grippers and/or suction cups will safely remove the printing plate without the aid of the guide fork movement. However, in some cases it is possible that the leading edge 8 is caught in the gap area and the automatic removal is not entirely assured. Such a situation then requires operator intervention, with the attendant delay in the plate removal. The otherwise one to two-minute automatic plate change would then take considerably longer and the downtime between print batches or print jobs is considerably extended.

The rotation of the guide fork 12 is indicated by an arrow 13. After the "freeing" of the leading edge, the removal process can then be continued by pulling the plate 7 completely out of the chute between the guide fork 12 and the guide 15 and placing the plate into the appropriate removal magazine.

Figure 4:
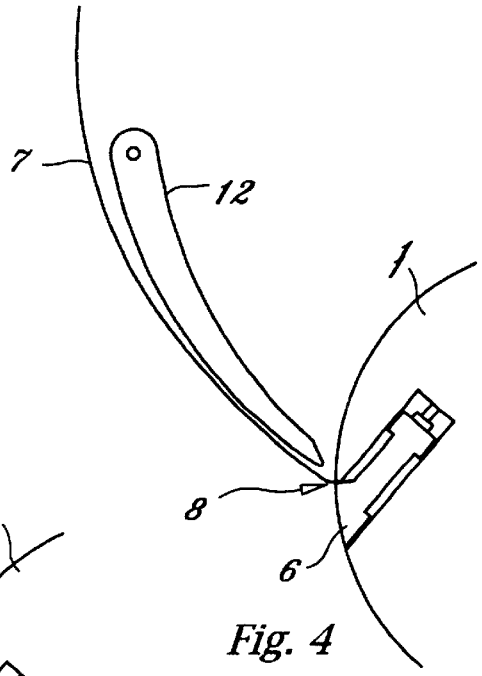
FIG. 4 is a similar view of an alternative embodiment, just prior to the removal of the leading edge of the printing plate from the plate cylinder.

Referring now to FIG. 4, which shows a further variation, after the printing plate 7 has been peeled from the plate cylinder 1, the bent leading edge 8 of the plate 7 could get caught or become otherwise entangled at the forward edge of the guide fork 12. It is therefore advantageous, according to the invention, to bend back the leading edge 8 and to essentially flatten the end portion of the plate 7. This may be effected in various ways. In a preferred embodiment, the locking mechanism is closed after the trailing edge 9 is safely in the removal chute between the guide forks 12 and 15. As the plate 7 is unwound from the plate cylinder 1 by rotating in the clockwise direction, and the guide fork 12 approaches the leading edge 8, which is still clamped in the plate gap by the lockup bar 6, the plate material is bent back to largely flatten the leading edge 8. The lockup bar 6 can be opened after the flattening of the plate 7 and the plate can be removed without the otherwise encumbering bent-back portion defining the leading edge 8. The removal of the bend at the leading edge 8 is further advantageous when the spent printing plate is placed into the removal magazine. This is typically effected by running the plate through pressure rollers which "iron" the bent plate edge back to assure a straight plate edge. The prebending with the guide fork 12 thereby assures that the pressure rollers will not bend the plate in the wrong direction and actually enforce the bend at the leading edge.

I claim:

1. A method of extracting a printing plate from a plate cylinder rotatably mounted in a printing unit, wherein a trailing edge and a leading edge of the printing plate are retained by a locking member in a plate gap of the plate cylinder, the method which comprises;

releasing the trailing edge of the printing plate from the locking member of the plate cylinder;

plastically deforming the printing plate at the trailing edge; and peeling the printing plate away and removing the printing plate from the plate cylinder.

2. The method according to claim 1, wherein the releasing step comprises axially displacing a lockup bar within an open passage of the plate cylinder and projecting a bearing surface of the lockup bar radially beyond a peripheral surface of the plate cylinder.

3. The method according to claim 2, wherein the deforming step comprises forcing the printing plate towards the peripheral surface of the plate cylinder in a vicinity of the lockup bar projecting beyond the peripheral surface.

4. The method according to claim 3, wherein the forcing step comprises biasing the printing plate against the peripheral surface of the plate cylinder with a tucker bar of an automatic plate change mechanism disposed in the printing unit.

5. The method according to claim 1, wherein the peeling step comprises placing a guide fork of an automatic plate change mechanism in the vicinity of the plastically deformed trailing edge, rotating the plate cylinder to force the trailing edge to run onto the guide fork, and deflecting the printing plate away from the plate cylinder while continuing the rotation of the plate cylinder.

6. The method according to claim 1, which comprises releasing the leading and trailing edges of the printing plate from a plate gap of less than 5 mm.

7. The method according to claim 6, wherein the plate gap is less than 1 mm.

8. The method according to claim 1, wherein the peeling and removing step comprises approaching the plate cylinder with a guide fork of an automatic plate change mechanism, rotating the plate cylinder counter to a printing rotation of the plate cylinder until the printing plate is completely removed from the plate cylinder by the guide fork.

9. The method according to claim 8, which further comprises pulling the leading edge from the plate lockup mechanism by pivoting the guide fork away from the plate cylinder.

10. A method of extracting a printing plate from a plate cylinder rotatably mounted in a printing unit, wherein a trailing edge and a bent-over leading edge of the printing plate are retained by a locking member in a plate gap of the plate cylinder, the method which comprises:

releasing the trailing edge of the printing plate from the locking member of the plate cylinder;

removing the printing plate from the plate cylinder with a guide fork of an automatic plate change mechanism, by rotating the plate cylinder and causing the printing plate to unravel from the plate cylinder; and prior to completely removing the printing plate, unbending a bent-over leading edge of the printing plate to substantially flatten the leading edge.

* * * * *